US007113101B2

(12) United States Patent
Petersen et al.

(10) Patent No.: US 7,113,101 B2
(45) Date of Patent: Sep. 26, 2006

(54) BLISTER PACKAGE WITH ELECTRONIC CONTENT MONITORING SYSTEM

(75) Inventors: Michael Petersen, Ottawa (CA); Allan Wilson, Ottawa (CA)

(73) Assignee: Intelligent Devices, Inc., Christ Church (BB)

( * ) Notice: Subject to any disclaimer, the term of this patent is extended or adjusted under 35 U.S.C. 154(b) by 105 days.

(21) Appl. No.: 10/500,481

(22) PCT Filed: Dec. 30, 2002

(86) PCT No.: PCT/CA02/02023

§ 371 (c)(1),
(2), (4) Date: Jun. 30, 2004

(87) PCT Pub. No.: WO03/055769

PCT Pub. Date: Jul. 10, 2003

(65) Prior Publication Data

US 2005/0122219 A1 Jun. 9, 2005

(30) Foreign Application Priority Data

Dec. 31, 2001 (CA) ..... 2366887

(51) Int. Cl.
*G08B 17/02* (2006.01)

(52) U.S. Cl. ..... 340/590; 368/10

(58) Field of Classification Search ..... 340/590, 340/568.1; 368/10, 11

See application file for complete search history.

(56) References Cited

U.S. PATENT DOCUMENTS 4,617,557 A 10/1986 Gordon
4,711,368 A * 12/1987 Simons ..... 340/545.6
5,072,430 A * 12/1991 Eckernas et al. ..... 368/10
5,871,831 A * 2/1999 Zeiter et al. ..... 428/76
6,411,567 B1 * 6/2002 Niemiec et al. ..... 368/10
6,574,166 B1 * 6/2003 Niemiec ..... 368/10

FOREIGN PATENT DOCUMENTS

| | | |
|---|---|---|
| DE | 19739438 | 11/1999 |
| WO | WO 00/18350 | 4/2000 |
| WO | WO 01/54646 | 8/2001 |

* cited by examiner

*Primary Examiner*—John Tweel, Jr.
(74) *Attorney, Agent, or Firm*—Jones, Tullar&Cooper, P.C.

(57) ABSTRACT

A replicate can be secured to a blister package intended to contain articles, such as pills, and is used to record the removal of individual articles from the blisters. To remove an article from a blister one will usually press against the blister to push the article through a frangible closure seal, breaking the seal in the process. The replicate includes a backing sheet which carries a plurality of traces alignable with corresponding blisters so that when the article is removed from the blister it will not only break the seal but it will also break the corresponding trace. All of the traces are connected to an integrated circuit which may also be formed or provided on the backing sheet, as is a power source for the integrated circuit. The breaking of the trace is an event that is recorded in the integrated circuit for later accessability. The replicate may be secured to the blister package after the package has been produced by conventional form-fill-seal equipment. The individual traces can be formed into a grid of closely spaced traces so that alignment of the traces with the individual blisters is less critical. The replicates may be formed by printing or other conventional methods on a roll of lidstock. After forming the individual replicates are severed from the roll of lidstock for securement to a blister package.

12 Claims, 5 Drawing Sheets

BLISTER PACKAGE WITH ELECTRONIC CONTENT MONITORING SYSTEM

CROSS-REFERENCE TO RELATED APPLICATION

This is a filing under 35 U.S.C. 371 of PCT/CA02/2023, filed Dec. 30, 2002, which claims priority from Canadian Application Serial No. 2,366,887, filed Dec. 31, 2001. PCT/CA02/2023 has been published as International Publication Number WO 03/055769, and the publication is in English.

FIELD OF THE INVENTION

This invention relates to a packaging device and a content use monitoring system and, more particularly, to a preformed backing sheet carrying electronic circuitry for use with a packaging device and a content use monitoring system that is primarily adapted to medication packaging and dispensing.

BACKGROUND OF THE INVENTION

Medications comprise a large component of health care. A limiting factor to the effectiveness of many medications is patient compliance with the prescriptions. Medications typically must be taken at specific intervals based on their pharmacokinetics to maximize plasma levels, and any substantial deviation from the prescribed interval may result in ineffectiveness or adverse effects. As the patient population ages, the incidence of medication errors increases.

A prior invention by Wilson and Petersen as disclosed in Canadian Patent Application No. 2,353,350 of Jul. 20, 2001 describes a packaging device for monitoring use of the contents of blister packages. The packaging device comprises a package, an electrically conducting path and an electronic chip embedded in, or supported by, the package. The package has one or more sealable receptacles for accommodating contents. The electrically conducting path is associated with each receptacle. It changes its characteristics when the receptacle is opened after being sealed. The electronic chip monitors the change in the characteristics of the conducting path, and generates content use data when the change in the characteristics of the conducting path is detected.

One practical difficulty with the Wilson and Petersen invention is that the electronic traces which establish the electronic path must be oriented accurately relative to the blisters or receptacles, between the contents and the lidstock or backing. A second difficulty lies in connecting the electrical traces to the electronic chip, which incorporates an integrated circuit (IC). A third-difficulty lies in the necessity of redesigning widely used form-fill-seal machines to carry out these functions.

It is desirable to have a simpler solution to the integration of electronic monitoring devices with the blister package, preferably so that widely existing form-fill-seal machines can still be used with little or no modification thereto.

SUMMARY OF THE INVENTION

The present invention relates specifically to the mounting of replicates of an electronic inventory control device for blister packaging on rolls of lidstock (backing) which can then be used to seal blister packaged medications or other contents by standard form-fill-seal devices.

The invention comprises replicates of a suitable integrated circuit (IC), a power source, and an electrically conducting trace system mounted on lidstock in such a way that the lidstock can be used with standard or only slightly modified form-fill-seal machinery to form a blister package. Each replicate encompasses an area of lidstock of dimensions appropriate for the desired blister package. On either the top or the bottom surface of the lidstock is located a pattern or a grid of electrically conducting traces each ultimately terminating at a contact of the IC, which has its own power supply, clock and non-volatile memory, and which is also attached to the lidstock. When attached to the package, each trace in one embodiment is designed to correspond to or to intersect a single blister of the package. When the contents of the blister are expelled though the backing the associated trace is broken. The IC tests the integrity of the traces at specified intervals and records the time of detection of a newly broken trace in the non-volatile memory.

In a second embodiment of the invention the traces are arranged in a grid without concern as to having each trace intersect a single blister. The grid is composed of a relatively large number of traces such that several traces of the grid will intersect each blister. When the contents of a blister are expelled therefrom the grid, rather than an individual trace, would be broken, causing a change in the resistance of the circuitry. This change in resistance would be recorded in the non-volatile memory of the IC as a timed event. By using the grid arrangement the need to align individual traces with the blisters is obviated and the positioning of the replicate relative to the package becomes less critical to effective operability. A replicate using a grid arrangement would have more universal applicability as the same design could be used with a large variety of different packages.

The information can be retrieved from the IC's memory at a later time by any suitable means, such as a non-contact reader, and displayed or analyzed as required.

Other aspects and features of the present invention will be readily apparent to those skilled in the art from a review of the following detailed description of preferred embodiments in conjunction with the accompanying drawings.

BRIEF DESCRIPTION OF THE DRAWINGS

The invention will be further understood from the following description with reference to the drawings in which.

DETAILED DESCRIPTION OF THE PREFERRED EMBODIMENTS

Figure 1:
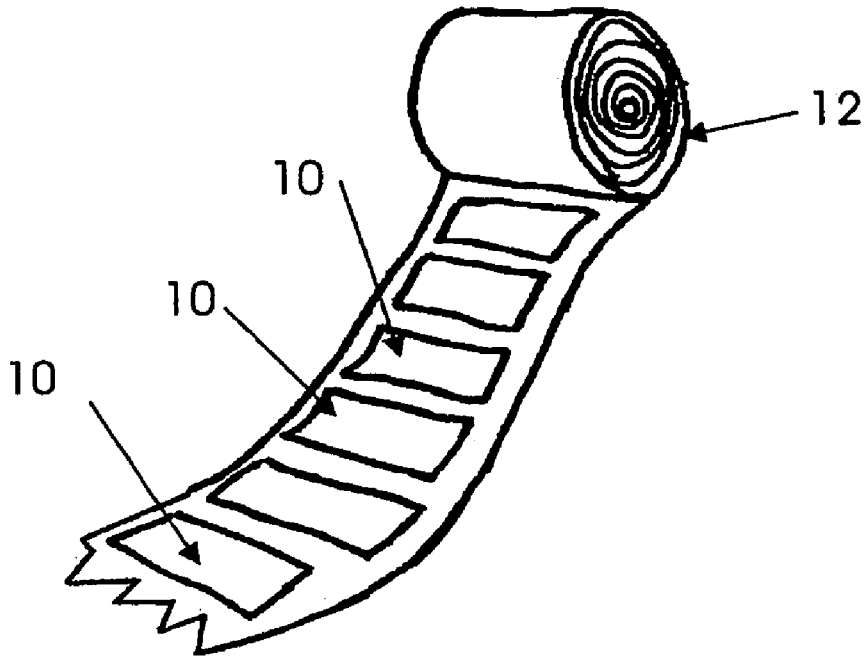
FIG. 1. Is a perspective view showing a roll of lidstock with a plurality of replicates of this invention thereon.
Figure 2:
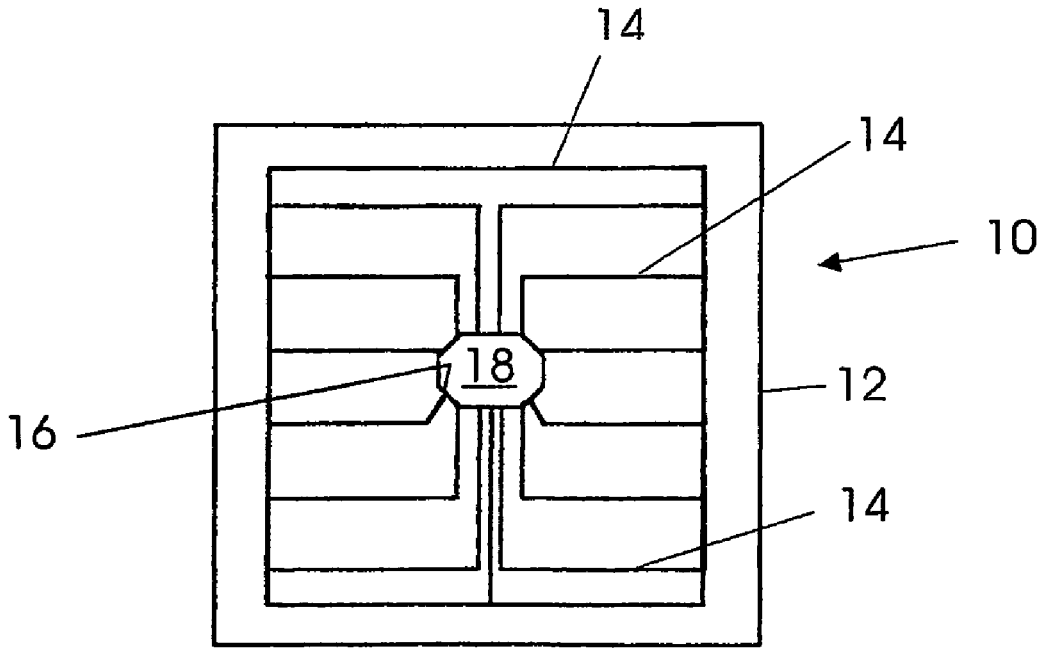
FIG. 2. Is a schematic view of a single replication of the integrated circuit and electrically conducting traces.
Figure 3:
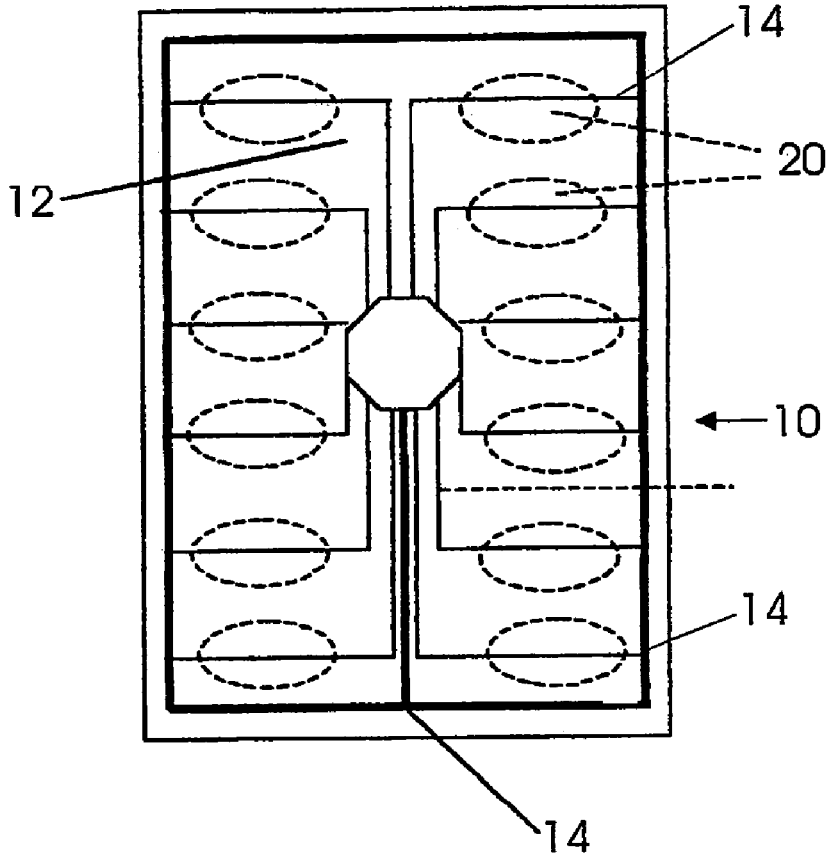
FIG. 3. Is a schematic view of a single replication of the integrated circuit and electrically conducting traces in relation to the position of the blisters.
Figure 4:
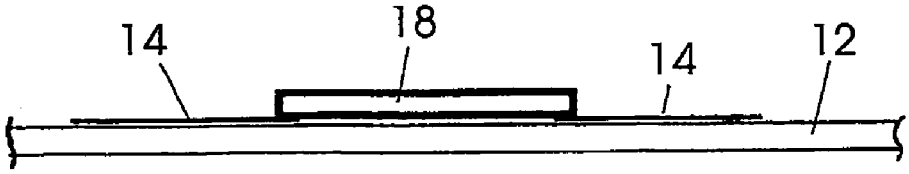
FIG. 4. Is schematic cross sectional view of the blister package including the backing with its integrated circuit and electrically conducting traces.

Referring to FIG. 1, replicates 10 of the electronic inventory control device of this invention are attached to a roll 12 of backing (lidstock) designed for blister packaging. FIG. 2 depicts a first embodiment of the invention wherein each replicate 10 comprises a network of electrically conducting traces 14 terminating on the contacts 16 of an integrated circuit (IC) 18 containing a power supply, clock, and non-volatile memory (not shown). The traces 14 are oriented so that each trace corresponds to the position of a blister 20 (FIG. 3) and so that expelling the contents of the blister through the backing will break the trace. At programmed intervals, the IC 18 samples the integrity of the traces and records the time that a broken trace is detected in its non-volatile memory.

The replicates can be mechanically attached to the backing 12, printed on the backing 12 (as by silk screening for example), or a combination of both techniques can be used. They can be located on either surface of the backing 12 (i.e.: inside or outside in reference to the blister package). The backing 12 may be a single sheet of material as shown or it may be a multi-layered laminate. In the event that a laminate is used, the traces may be sandwiched between layers of the laminate.

The IC 18 may be, but is not limited to, a standard smart card IC attached to the backing 12 in such a way as to have its terminal coincide with the ends of the electrically conducting traces 14. It may also be printed on the lidstock using emerging thin-film technology.

The power supply may be, but is not limited to, an integral part of the IC 18. It may be of conventional design as used for smart cards and similar applications or it may be printed directly on the backing. The IC can be of the digital or the analog variety and can employ volatile memory as well as the preferred non-volatile memory mentioned herein. The IC can be adapted for use with infrared, and radio frequency, proximity and contact reader systems to facilitate the downloading of event information as recorded in the memory of the IC.

The traces 14 can be made of any electrically conducting material affixed to or printed on the backing.

Also included in the invention is the use of an adhesive lidstock that can be applied to the back of an already finished blister package to allow for inventory control as described using already packaged contents.

Figure 5:
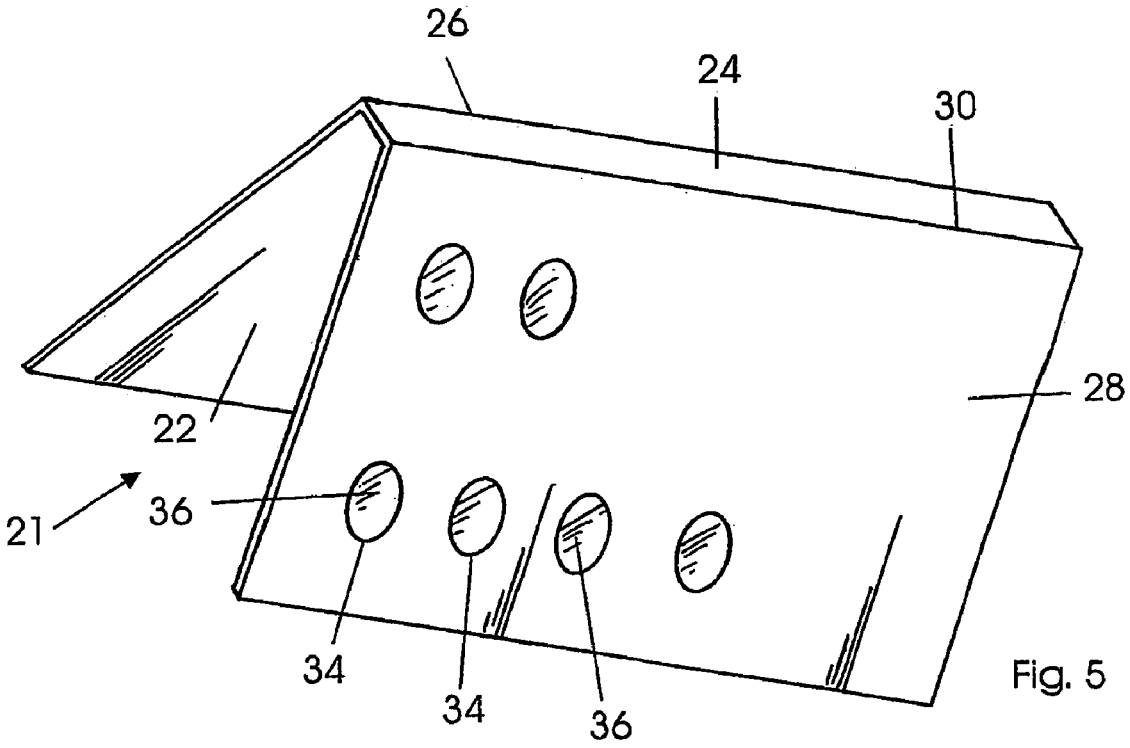
FIG. 5 is a rear perspective view of another form of blister package incorporating the present invention.
Figure 6:
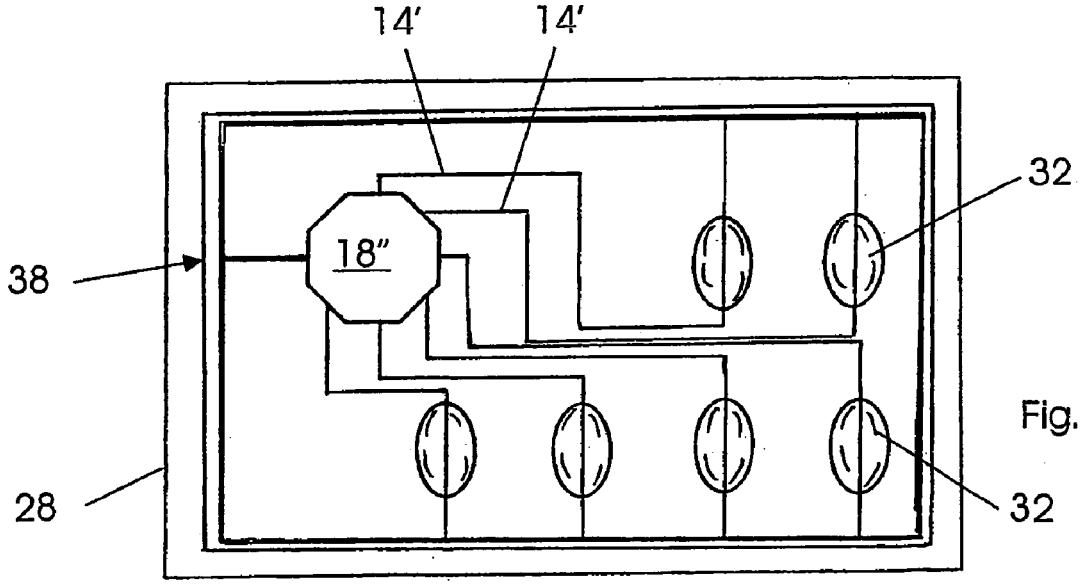
FIG. 6 is a front view of the rear flap of the package of FIG. 5 with a replicate of the present invention thereon.

FIGS. 5 and 6 illustrate another type of package that can benefit from the present invention. Therein a foldable package 20 has a front flap 22 which may carry product information, a spine 24 to which the front flap is attached along fold line 26, and a second or rear flap 28 which is hingedly attached to the spine 24 along fold line 30. The rear flap 28 carries a plurality of blisters or receptacles 32 on the inside surface thereof, which blisters are normally protected by the front flap 22. The outside surface of the rear flap has a plurality of openings 34 therethrough in alignment with the blisters 32, each opening being covered by a thin layer 36 of a frangible material. Secured to, preferably, the inside surface of the rear flap is a replicate 38 of the present invention which includes an electronic chip 18' incorporating an integrated circuit, a power source and a non-volatile memory, and a plurality of traces 14' which intersect the blisters 32. The chip and the traces will be protected by the front flap 22 in the normal condition of the package.

When the front flap is lifted the blisters are exposed and the contents of a selected blister can be pushed through the frangible material 36 at the rear surface. Preferably, as shown, the traces 14' will intersect the openings 34 such that each trace intersecting an opening will be disrupted when the contents of the associated blister are pushed through the frangible material 36. This causes the detectable change in characteristics referenced hereinabove, which change is stored in the non-volatile memory for later downloading.

Figure 7:
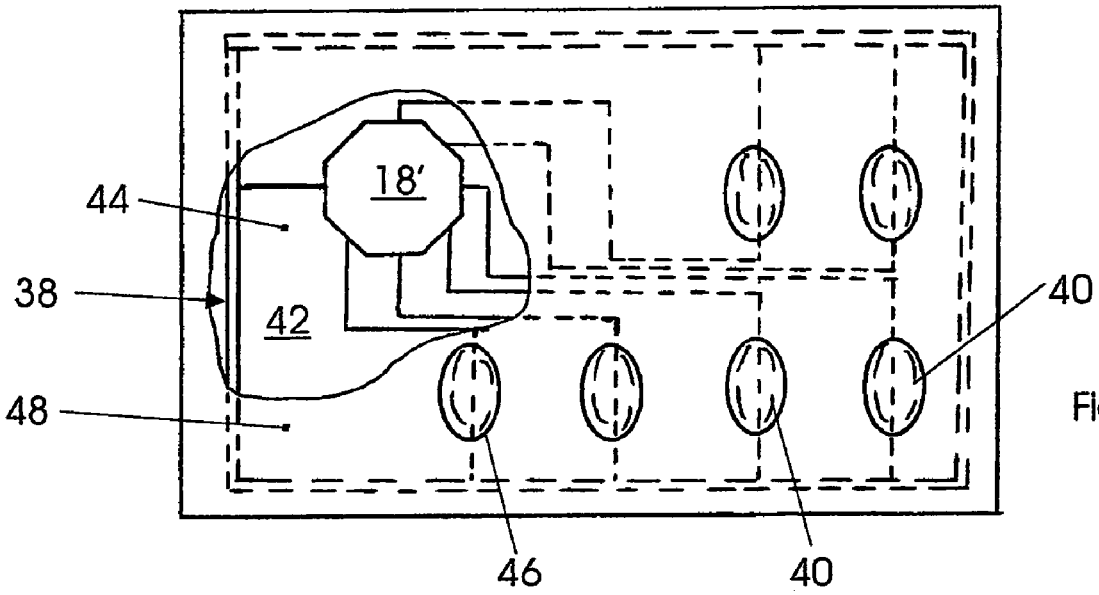
FIG. 7 is a partially broken away front view of the package of FIG. 5 showing the replicate captured between two layers of the rear flap of the package.

If the rear flap of the package is formed of more than one layer of material then the replicate carrying the electronic chip 18' and the traces 14' could be located between two of the layers so that it would be hidden from view. This is shown in FIG. 7 wherein it is seen that the blisters 40 are secured to the inside surface 42 of the rear panel 44 of the rear flap and project through openings 46 in the front panel 48 of the rear flap. The replicate 38 is in turn secured to, preferably, the inside surface 42 of the rear panel 44 so that it is sandwiched or captured between the front and rear panels 44, 48 during final assembly of the package as it flows through a form-fill-seal packaging machine.

While the IC 18' is illustrated in FIGS. 6 and 7 as being located on the same flap 28 as the traces 14' and the blisters 32 it could just as easily be located on the flap 22, separated from the blisters and connected via traces which extend over the spine 24 to the traces 14' which intersect the blisters. This configuration would be used when the entire flap 28 is covered by blisters and there is no room on or in the flap for the IC itself.

Figure 8:
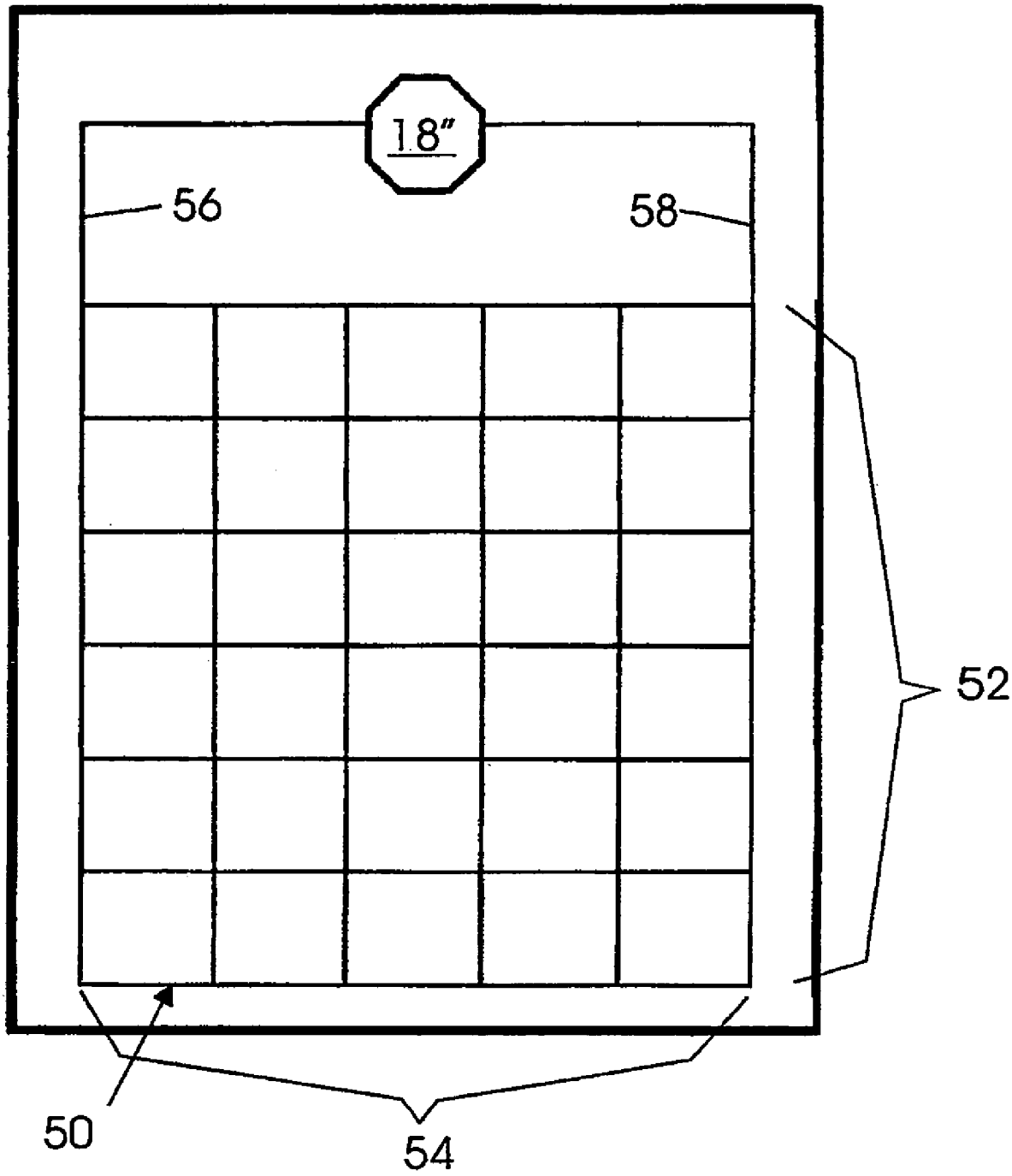
FIG. 8 is a schematic representation of a single replicate of this invention with an electrically-conducting grid associated therewith.

FIG. 8 illustrates yet another embodiment of the present invention wherein the individual traces 14, 14', which must be positioned so that each intersects a corresponding blister, are replaced by a fine mesh-like grid 50. The grid 50 is made up of sets of electrically conducting traces 52, 54 with the traces 52 intersecting the traces 54 at right angles. The spacing between individual traces within each set is considerably less than the spacing between traces in the other embodiments, the result being that each blister will overly several of the traces making up the sets 52, 54. The sets 52, 54 are in turn connected by traces 56, 58 to the IC 18". Whenever the contents of an individual blister are expelled therefrom the plurality of traces therebelow will be ruptured, causing a change in the resistance of the circuit, which change is recorded in the non-volatile memory of the IC 18" for later downloading. With this embodiment the need to accurately align blisters and traces, to ensure that each blister is associated with a corresponding single trace is obviated.

The foregoing has described the present invention and several means of putting the invention into effect. It is understood that the invention can be effected in a multitude of different ways without departing from the spirit of the invention. Accordingly the protection to be afforded this invention is to be determined from the scope of the claims appended hereto.

The invention claimed is:

1. A replicate for application to a blister package containing a plurality of articles, each in an individual blister such that each such article can be projected through a corresponding portion of the package and the replicate for removal from the package, said replicate including a frangible backing sheet, an integrated circuit on said backing sheet, a power source for the integrated circuit, means for attaching said replicate to said package, and a plurality of individual electrically conductive traces on said backing sheet, said traces defining a grid pattern of intersecting sets of parallel such traces, said traces being positioned on said backing sheet so that more than one thereof will intersect each of said blisters when said replicate is attached to said package, said intersecting sets of traces being connected to said integrated circuit, whereby when an article is projected from its blister through said replicate the corresponding traces are broken, so as to define an event that can be recorded by said integrated circuit.

2. The replicate of claim 1 wherein said integrated circuit includes a clock and a non-volatile memory, whereby a time associated with each event can be recorded in said memory for retrieval at a later point in time.

3. The replicate of claim 1 wherein said power supply is integral with said integrated circuit.

4. The replicate of claim 1 wherein said integrated circuit and said traces are printed on said backing sheet.

5. The replicate of claim 1 wherein an adhesive is applied to said backing sheet for attachment of said replicate to said blister package.

6. The replicate of claim 1 wherein a cover sheet is applied to said replicate with said integrated circuit and said conductive traces sandwiched between said cover sheet and said backing sheet to create a laminated replicate.

7. A blister package comprising:

a sheet of material having a plurality of openings therethrough;

a plurality of individual flexible blisters mounted to one surface of said sheet, each of said blisters being in registry with a corresponding opening;

an article located in each of said blisters;

a closure seal formed of frangible material extending across each said opening so as to hermetically capture the article in the corresponding blister;

a replicate secured to the opposite surface of said sheet, said replicate including;

a frangible backing sheet;

an integrated circuit on said backing sheet;

a power source for the integrated circuit;

means for attaching said replicate to said opposite surface; and a plurality of individual electrically conductive traces on said backing sheet, said traces defining a grid pattern of intersecting sets of parallel such traces;

said intersecting sets of traces being positioned on said backing sheet so that more than one thereof will intersect a corresponding one of said closure seals when said replicate is attached to said package, said intersecting sets of traces being connected to said integrated circuit, whereby when an article is projected from its blister through said closure seal and said replicate the corresponding traces are broken, so as to define an event that can be recorded by said integrated circuit.

8. A blister package comprising:

a sheet of material having a plurality of openings therethrough;

a plurality of individual flexible blisters mounted to one surface of said sheet, each of said blisters being in registry with a corresponding opening;

an article located in each of said blisters;

a closure seal formed of frangible material extending across each said opening so as to hermetically capture the article in the corresponding blister;

a replicate secured to said one surface of said sheet, said replicate including:

a frangible backing sheet;

an integrated circuit on said backing sheet;

a power source for the integrated circuit;

means for attaching said replicate to said one surface; and a plurality of individual electrically conductive traces on said backing sheet, said traces defining a grid pattern of intersecting sets of parallel such traces;

said sets of intersecting traces being positioned on said backing sheet so that more than one thereof will intersect a corresponding one of said blisters when said replicate is attached to said package, said intersecting sets of traces being connected to said integrated circuit, whereby when an article is projected from its blister through said closure seal and said replicate the corresponding traces are broken, so as to define an event that can be recorded by said integrated circuit.

9. The package of claim 8 including a cover sheet through which said blisters project, said cover sheet being applied to said one surface of said backing material so as to capture said replicate between itself and said one surface of said backing material.

10. A blister package comprising:

a first flap, a second flap, and a spine hingedly attached to each of said first and second flaps;

a plurality of individual flexible blisters mounted to an inside surface of said second flap;

a plurality of openings extending through a rear surface of said second flap, each of said openings being in registry with a corresponding blister;

an article located in each of said blisters;

a closure seal formed of frangible material extending across each said opening so as to hermetically capture the article in the corresponding blister;

a replicate secured to said inside surface of said second flap, said replicate including:

a frangible backing sheet;

an integrated circuit;

a power source for the integrated circuit;

means for attaching said replicate to said second flap; and a plurality of individual electrically conductive traces on said backing sheet, said traces defining a grid pattern of intersecting sets of parallel such traces;

said sets of intersecting traces being positioned on said backing sheet so that more than one thereof will intersect a corresponding one of said blisters when said replicate is attached to said second flap, said intersecting sets of traces being connected to said integrated circuit, whereby when an article is projected from its blister through said closure seal and said replicate the corresponding traces are broken, so as to define an event that can be recorded by said integrated circuit.

11. The package of claim 10 wherein said integrated circuit is provided on said backing sheet.

12. The package of claim 10 wherein said integrated circuit is provided on said first flap.

* * * * *